US007975878B2

(12) United States Patent
Wemmert

(10) Patent No.: US 7,975,878 B2
(45) Date of Patent: Jul. 12, 2011

(54) PROJECTED FUEL DISPENSING NOZZLE

(75) Inventor: Marlene Wemmert, Malmo (SE)

(73) Assignee: Dresser, Inc., Addison, TX (US)

( * ) Notice: Subject to any disclaimer, the term of this patent is extended or adjusted under 35 U.S.C. 154(b) by 877 days.

(21) Appl. No.: 11/804,097

(22) Filed: May 17, 2007

(65) Prior Publication Data

US 2008/0006652 A1 Jan. 10, 2008

(30) Foreign Application Priority Data

May 24, 2006 (EP) ..... 06114493

(51) Int. Cl.
*B67D 7/12* (2010.01)

(52) U.S. Cl. ..... 222/74; 222/330; 222/538; 433/77; D15/9.1; D15/9.2

(58) Field of Classification Search ..... D15/9.1, D15/9.2, 9.3; D24/177; 222/74, 75, 330, 222/331, 530, 538, 14–22, 23–29; 433/77
See application file for complete search history.

(56) References Cited

U.S. PATENT DOCUMENTS 3,199,727 A * 8/1965 Romanowski ..... 222/20
4,240,475 A * 12/1980 Schulz ..... 222/74
D262,970 S * 2/1982 Rowan et al. ..... D15/9.2
4,576,312 A * 3/1986 Swick, Jr. ..... 222/27
D309,144 S * 7/1990 Austin et al. ..... D15/9.2
5,083,846 A * 1/1992 Day et al. ..... 222/74
5,651,478 A * 7/1997 Tatsuno ..... 222/25
5,896,720 A * 4/1999 Bond ..... 24/336
D414,778 S * 10/1999 Keane et al. ..... D15/9.1
7,581,951 B2 * 9/2009 Lehmann et al. ..... 433/77
2001/0030199 A1 * 10/2001 DiRocco ..... 222/74

FOREIGN PATENT DOCUMENTS

WO WO 2005002489 A1 * 1/2005 ..... 433/77

OTHER PUBLICATIONS

European Search Report for EP 06114493.7 dated Dec. 21, 2006 (4 pages).

* cited by examiner

*Primary Examiner* — Kevin P Shaver
*Assistant Examiner* — Jonathan Wood
(74) *Attorney, Agent, or Firm* — Fish & Richardson P.C.

(57) ABSTRACT

A fuel dispensing unit for refueling vehicles includes a first nozzle holder for holding a first fuel dispensing nozzle, and a second nozzle holder for holding a second fuel dispensing nozzle. Both nozzle holders are arranged on a common side of the fuel dispensing unit. The first nozzle holder is configured to project, in a direction away from the side of the fuel dispensing unit, at least a part of the first fuel dispensing nozzle in relation to a corresponding part of the second fuel dispensing nozzle.

10 Claims, 3 Drawing Sheets

PROJECTED FUEL DISPENSING NOZZLE

CLAIM OF PRIORITY

This application claims priority under 35 U.S.C §119 to European Patent Application No. 06114493.7, filed on May 24, 2006, the entire contents of which are herby incorporated by reference.

TECHNICAL FIELD

The present invention relates to a fuel dispensing unit comprising a first nozzle holder for holding a first fuel dispensing nozzle, and a second nozzle holder for holding a second fuel dispensing nozzle. Both nozzle holders are arranged on a common side of the fuel dispensing unit.

BACKGROUND ART

A fuel dispensing unit typically comprises a pump part standing on the ground, a display part positioned above the pump part and showing the chosen type of petrol, cash readout, volume read out etc, and a column to which one or more petrol hoses are connected. A fuel delivery nozzle is connected at the end of each fuel hose, and each fuel delivery nozzle normally rests in a nozzle boot, or a nozzle holder arranged on a side of the fuel dispensing unit.

When the tank of a vehicle is to be filled up, the driver parks the vehicle beside the fuel dispensing unit and removes the cap of the vehicle's petrol tank. Then the driver selects the desired type of petrol, removes the corresponding delivery nozzle from its nozzle holder, places the fuel delivery nozzle in the inlet of the vehicle's petrol tank and puts in the desired volume of petrol.

When the filling-up is completed, the driver puts the fuel delivery nozzle in its nozzle holder. Simultaneously, hose retracting means return the hose to a hose storage space in the column. Convenient handling of the hose and delivery nozzle as well as efficient hose retraction is important, and several solutions exist for addressing these issues.

EP-1243549, for example, discloses a hose returning device having a hose housing and two sequentially cooperating hose returning means, which both are spring loaded for returning the hose. The delivery nozzle normally rests in a nozzle boot and it is known to arrange two hose returning mechanisms and, consequently, two fuel hoses, two fuel delivery nozzles and two nozzle boots next to each other.

A problem common to prior-art hose handling devices is that fuel hoses may get entangled. Another problem is that a fuel hose may land in front of a fuel delivery nozzle belonging to an adjacent hose, when the delivery nozzle rests in its nozzle holder, which obscures the delivery nozzle and renders it difficult for a user to grab it for refueling.

SUMMARY OF THE INVENTION

It is an object of the present invention to provide an improvement of the above techniques and prior art.

A particular object is to provide a fuel dispensing unit where fuel hoses are less entangled and where fuel dispensing nozzles are less obscured and thereby easier to grab.

These and other objects as well as advantages that will be apparent from the following description of the present invention are achieved by a fuel dispensing unit described below.

Hence a fuel dispensing unit for refueling vehicles is described, said fuel dispensing unit comprising a first nozzle holder for holding a first fuel dispensing nozzle, and a second nozzle holder for holding a second fuel dispensing nozzle, both nozzle holders being arranged on a common side of the fuel dispensing unit. The first nozzle holder being configured to project, in a direction away from said side of the fuel dispensing unit, at least a part of the first fuel dispensing nozzle in relation to a corresponding part of the second fuel dispensing nozzle.

The inventive fuel dispensing unit is advantageous in that a hose connected to the first dispensing nozzle tends to fall to the side of the first nozzle boot, opposite the second nozzle boot, which results in the second dispensing nozzle and/or the hose associated with the second dispensing nozzle generally being less obscured.

It has also been observed that a second fuel hose associated with the second delivery nozzle has a tendency to impinge on the adjacent hose associated with the first fuel dispensing nozzle, resulting in the first dispensing nozzle and/or the hose associated with the first dispensing nozzle generally being less obscured.

Another advantage is that it is easier for a user to grasp as well as return any of the two dispensing nozzles, if one of the nozzle holders is projected according to the invention. This is particularly advantageous if the first fuel dispensing nozzle delivers a type of fuel that is most commonly purchased.

The first nozzle holder may be configured to project, in a direction away from said side of the fuel dispensing unit, a handle of the first fuel dispensing nozzle in relation to a corresponding handle of the second fuel dispensing nozzle, which provides a convenient arrangement since a fuel hose is connected to a handle or grip of a fuel delivery nozzle, and since the handle is the lowermost part of the fuel delivery nozzle.

At least a portion of the first nozzle holder may protrude, in said direction, in relation to a corresponding portion of the second nozzle holder. This arrangement provides for an appropriate configuration since the delivery nozzle generally rests directly in its nozzle holder, meaning that the projection of the delivery nozzle depends on the protrusion of its holder.

A lower portion of the first nozzle holder may protrude, in said direction, in relation to a corresponding lower portion of the second nozzle holder, which facilitates a suitable solution since the lower part of the first delivery nozzle will be projected in relation to the lower part of the second delivery nozzle.

The first nozzle holder may protrude, in said direction, in relation to the second nozzle holder, which provides a highly feasible configuration.

The first nozzle holder may comprise sides extending in said direction and being at least partly wider than corresponding sides of the second nozzle holder. Preferably the full height or the lower part of the side of the first nozzle holder is wider.

The first and second nozzle holders may be configured to hold the fuel dispensing nozzles separated by a distance less than 25 cm along a first direction, said first direction being perpendicular to a normal to said side. This arrangement is advantageous since it has been observed that this distance is the maximum distance to achieve less tangling of hoses and less obscured delivery nozzles. In other words the first nozzle holder is positioned adjacent to the second nozzle holder.

The first and second nozzle holders may be configured to hold the fuel dispensing nozzles separated by a distance less than 15 cm along a second direction, said second direction being perpendicular to the normal and to the first direction. This arrangement is advantageous since it has been observed that this second distance is the maximum distance to achieve less tangling of hoses and less obscured delivery nozzles.

An insert may be mounted between the first nozzle holder and said common side of the fuel dispensing unit, for projecting at least a portion of the first nozzle holder in said direction, which facilitates cost efficient assembly as well as retro-fit of existing nozzle holders for incorporating the present invention.

Said direction away from the side of the fuel dispensing unit may be a normal to said side, for providing a suitable direction.

Each fuel dispensing nozzle may be connected to a respective fuel hose, and each fuel hose may be connected to an upper part of the fuel dispensing unit, which provides configurations particularly suitable for implementing the present invention.

The previously used term "corresponding part" refers to functionally identical parts of the fuel dispensing nozzles/nozzle holders.

BRIEF DESCRIPTION OF THE DRAWINGS

Embodiments of the present invention will now be described, by way of example, with reference to the accompanying schematic drawings, in which.

DETAILED DESCRIPTION OF EMBODIMENTS

Figure 1:
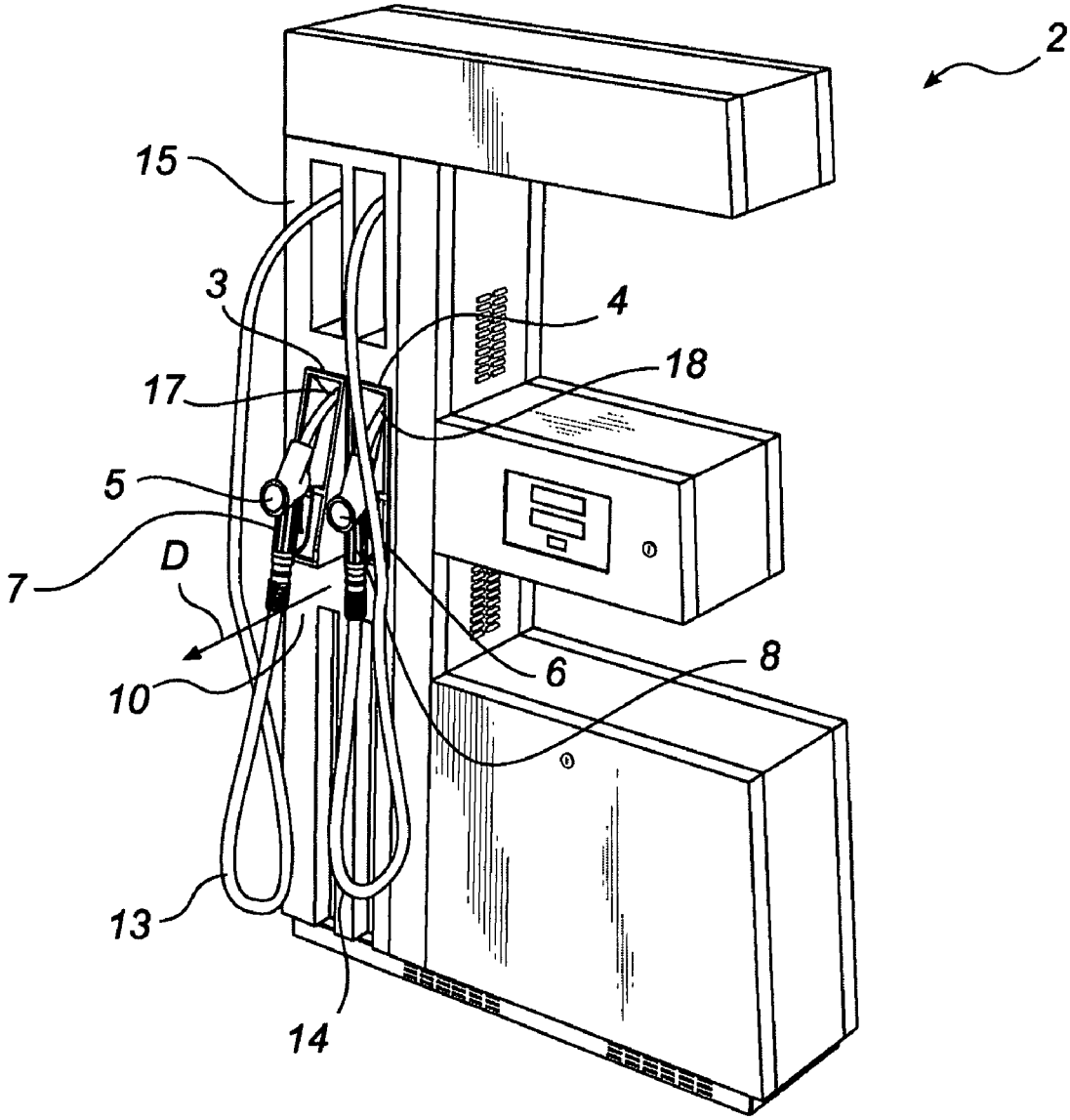
FIG. 1 is a perspective view of a fuel dispensing unit.
Figure 2:
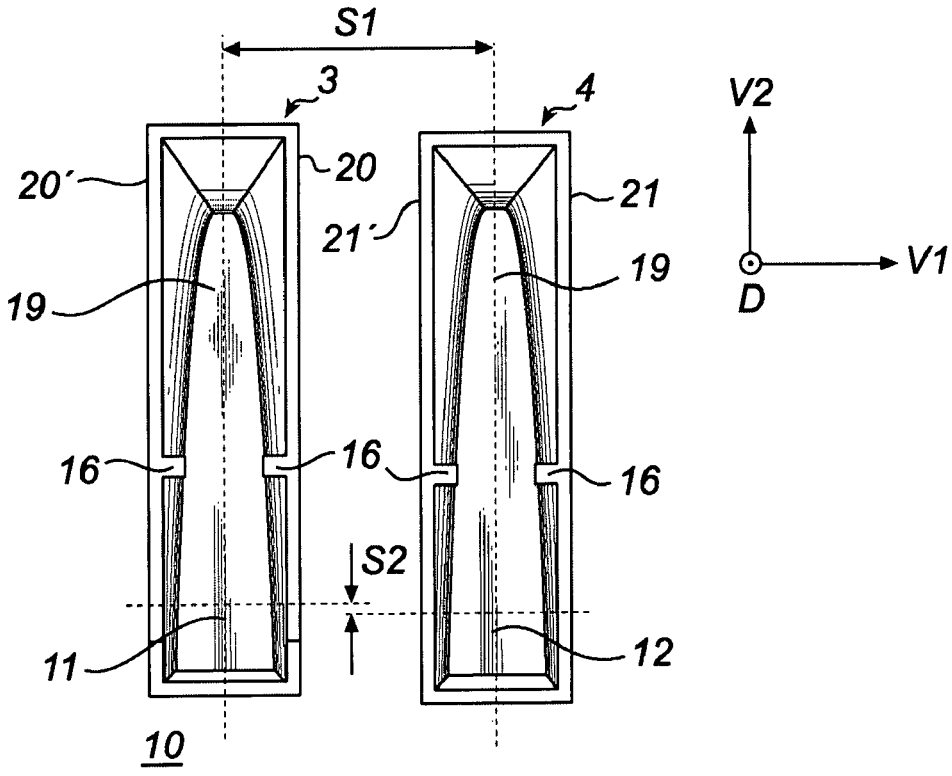
FIG. 2 is a detailed front view of two nozzle holders.

With reference to FIGS. 1 and 2, a fuel dispensing unit 2 is illustrated having a first fuel hose 13 and a second fuel hose 14. Both hoses 13, 14 are suspended from a top part 15 of the fuel dispenser 2. A first fuel dispensing nozzle 5 has a nozzle outlet 17 for letting out fuel and a handle 7 connected to an end of the first hose 13, and a second fuel dispensing nozzle 6 has a nozzle outlet 18 for letting out fuel and a handle 8 connected to an end of the second hose 14.

On a side 10 of the fuel dispensing unit 2 a first nozzle holder 3 and a second nozzle holder 4 are arranged adjacent to each other. When the fuel dispensing unit 2 is not operated, the first dispensing nozzle 5 rests in the first nozzle holder 3 and the second dispensing nozzle 6 rests in the second nozzle holder 4.

Each nozzle holder 3, 4 comprises a substantially rectangular frame and holding pegs 16 for holding the respective dispensing nozzle 4, 5 and has an upper recess 19 for receiving a nozzle outlet 17, 18 and a lower portion 11, 12 for receiving a handle 7, 8 of the respective Dispensing nozzle 5, 6.

The first nozzle holder 3 protrudes in relation to the second nozzle holder 4 along a direction D, or more specifically a lower portion 11 of the first nozzle holder 3 protrudes in relation to a lower portion 12 of the second nozzle holder 4.

Hence the first nozzle holder 3 comprises side portions 20, 20' that are wider, in the direction D from the common side 10, than corresponding side portions 21, 21' of the second nozzle holder 4. The full length and/or only a lower part of the side portions 20, 20' of the first holder 3 is wider than the side portions 21, 21' of the second holder 4.

Apart from the first nozzle holder 3 protruding in relation to the second nozzle holder 4, the holders 3, 4 are preferably identical for accommodating and holding substantially identical fuel dispensing nozzles 5, 6.

The direction D is parallel with a normal direction of the side 10 of the fuel dispensing unit 2, and it should be noted the direction D is generally directed towards a user operating any of the dispensing nozzles 5, 6. The side 10 is planar or substantially planar meaning that the two nozzle holders 3, 4 are attached to the side 10 in the same plane. However, the side 10 may but incorporate various cutouts.

Since the first nozzle holder 3 protrudes in the direction D, the handle 7 of the first fuel dispensing nozzle 5 is projected in the direction D in relation to the handle 8 of the second fuel dispensing nozzle 6.

The distance S1 between the center of the lower portion 11 of the first nozzle holder 3 and the center of the lower portion 12 of the second nozzle holder 4 is less than 25 cm along a first direction V2 perpendicular to D. The first direction V2 is parallel to the sides 20, 20', 21 and 21' of the holders 3, 4, and generally the first direction V2 is substantially vertical.

The distance S2 between the lower portion 11 of the first nozzle holder 3 and the lower portion 12 of the second nozzle holder 4 is less than 15 cm along a second direction V1 perpendicular to D and perpendicular to the first direction V2. Generally, the second direction V1 is substantially horizontal.

Figure 3:
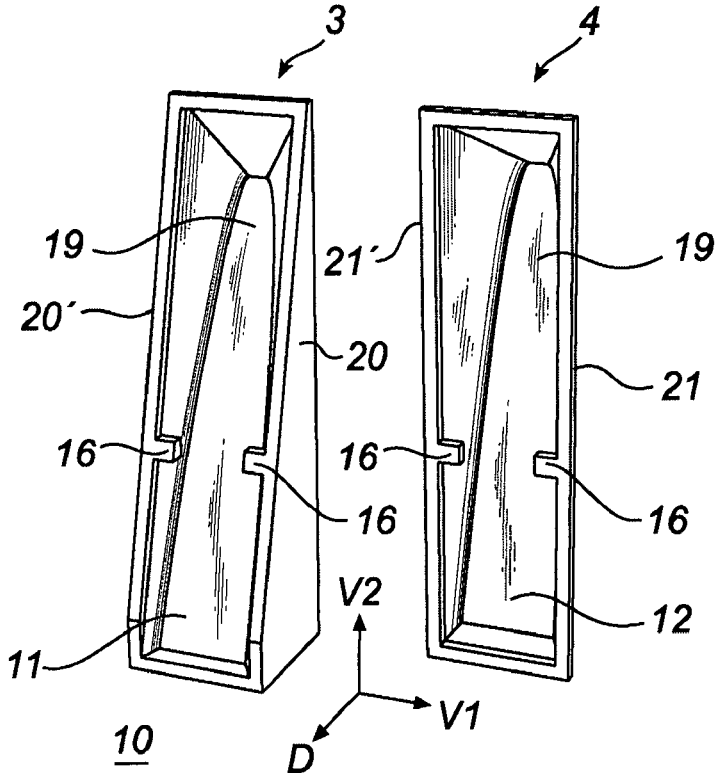
FIG. 3 is a detailed perspective view of two nozzle holders according to a first embodiment.
Figure 4:
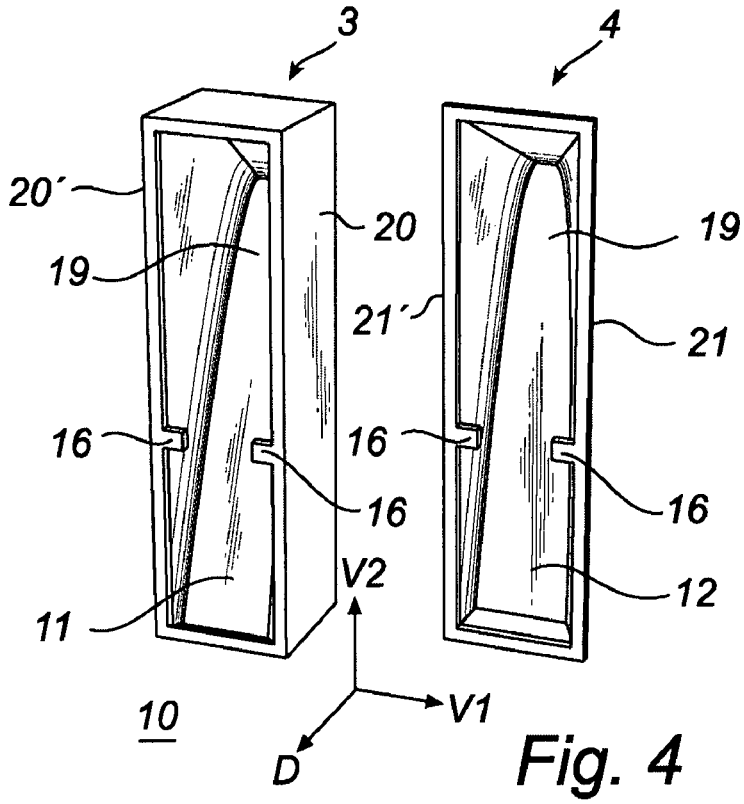
FIG. 4 is a detailed view of two nozzle holders according to a second embodiment.

FIG. 3 illustrates an embodiment where the lower portion 11 of the first nozzle holder 3 is protruded in relation to the lower portion 12 of the second nozzle holder 4, while FIG. 4 illustrates an embodiment where the complete first nozzle holder 3 is protruded in relation to the second nozzle holder 4.

Figure 5:
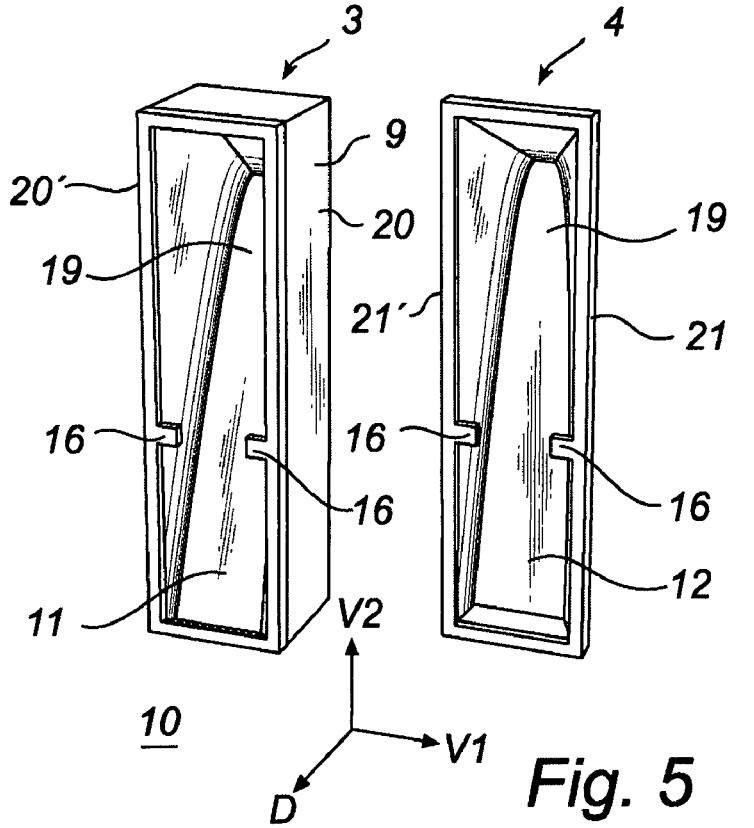
FIG. 5 is a detailed view of two nozzle holders according to a third embodiment.

FIG. 5 illustrates an embodiment where an insert 9 is mounted between the first nozzle holder 3 and the side 10 of the fuel dispensing unit 2, which thereby gives the first nozzle holder 3 a protruded position in relation to the second nozzle holder 4.

The fuel dispensing unit 2 and the fuel dispensing nozzles 5, 6 are operated in a conventional manner.

It should be noted that hoses retracted from a lower part of the fuel dispensing unit (a part below the nozzle holders) are also less entangled if the fuel dispensing unit comprises nozzle holders according to the invention.

Of course, the fuel dispensing unit may comprise further nozzle holders arranged adjacent the first and second nozzle holders, in which case a proper combination of protruding nozzle holders is selected.

The common side 10 does not have to be vertical but may be inclined, as long as the holders 3, 4 both are arranged on the same surface. As mentioned the common side 10 itself is substantially planar, and the term "common" denotes that both nozzle holders 3, 4 are arranged on the same side 10.

Of course, the holders 3, 4 may be partly or fully integrated with the common side 10 without departing from the scope of present invention.

The invention claimed is:

1. A fuel dispensing unit for refueling vehicles, said fuel dispensing unit comprising:

a first fuel dispensing nozzle connected to a first fuel hose;

a second fuel dispensing nozzle connected to a second fuel hose;

a first nozzle holder for holding the first fuel dispensing nozzle, and a second nozzle holder for holding the second fuel dispensing nozzle, both nozzle holders being arranged on a common side of the fuel dispensing unit, wherein at least a portion of the first nozzle holder protrudes further from said common side of the fuel dispensing unit in a direction substantially orthogonal to said common side in relation to a corresponding portion of the second nozzle holder, and wherein the first nozzle holder projects at least a part of the first fuel dispensing nozzle a first distance away from said common side of the fuel dispensing unit in the direction substantially orthogonal to said common side, and the second nozzle holder projects a corresponding part of the second fuel dispensing nozzle a second distance away from said common side of the fuel dispensing unit in the direction substantially orthogonal to said common side, the first distance greater than the second distance.

2. A fuel dispensing unit according to claim 1, wherein the part of the first fuel dispensing nozzle comprises a handle of the first fuel dispensing nozzle and the corresponding part of the second fuel dispensing nozzle comprises a handle of the second fuel dispensing nozzle.

3. A fuel dispensing unit according to claim 1, wherein the portion of the first nozzle holder is a lower portion of the first nozzle holder, and the corresponding portion of the second nozzle holder is a lower portion of the second nozzle holder.

4. A fuel dispensing unit according to claim 1, wherein the first nozzle holder comprises sides extending in said direction and being at least partly wider than corresponding sides of the second nozzle holder.

5. A fuel dispensing unit according to claim 1, wherein the first and second nozzle holders are configured to hold the fuel dispensing nozzles separated by a distance less than 25 cm along a first direction, said first direction being perpendicular to a normal to said common side.

6. A fuel dispensing unit according to claim 5, wherein the first and second nozzle holders are configured to hold the fuel dispensing nozzles separated by a distance less than 15 cm along a second direction, said second direction being perpendicular to said normal and to the first direction.

7. A fuel dispensing unit according to claim 1, wherein an insert is mounted between the first nozzle holder and said common side of the fuel dispensing unit, for projecting at least a portion of the first nozzle holder in said direction.

8. A fuel dispensing unit according claim 1, wherein said direction away from the side of the fuel dispensing unit is a normal to said common side.

9. A fuel dispensing unit according to claim 1, wherein each respective fuel hose provides fuel to the respective fuel dispensing nozzles.

10. A fuel dispensing unit according to claim 1, wherein the first and second fuel hoses are urged in laterally opposite directions substantially parallel to the common side.

* * * * *